US009826821B2

(12) United States Patent
Cao et al.

(10) Patent No.: US 9,826,821 B2
(45) Date of Patent: Nov. 28, 2017

(54) BROOM AND MANUFACTURING METHOD THEREOF

(71) Applicant: WUHAN YANGYANG YUANLV MINI-RESERVOIRS CO., LTD., Wuhan (CN)

(72) Inventors: Mengyi Cao, Wuhan (CN); Yuwei Wang, Wuhan (CN); Cailing Lu, Wuhan (CN); Junsheng Cao, Wuhan (CN); Chen Chen, Wuhan (CN)

(73) Assignee: WUHAN YANGYANG YUANLV MINI-RESERVOIRS CO., LTD., Wuhan (CN)

( * ) Notice: Subject to any disclaimer, the term of this patent is extended or adjusted under 35 U.S.C. 154(b) by 710 days.

(21) Appl. No.: 14/362,540

(22) PCT Filed: Nov. 27, 2012

(86) PCT No.: PCT/CN2012/085318
§ 371 (c)(1),
(2) Date: Jun. 3, 2014

(87) PCT Pub. No.: WO2013/078978
PCT Pub. Date: Jun. 6, 2013

(65) Prior Publication Data

US 2014/0331427 A1 Nov. 13, 2014

(30) Foreign Application Priority Data

Dec. 3, 2011 (CN) ..... 2011 1 0396628

(51) Int. Cl.
*A46D 1/04* (2006.01)
*A46D 3/00* (2006.01)
(Continued)

(52) U.S. Cl.
CPC ..... *A46B 3/08* (2013.01); *A46D 1/0207* (2013.01); *A46D 1/0215* (2013.01); *A46D 1/05* (2013.01);
(Continued)

(58) Field of Classification Search
CPC ..... A46D 1/0215; A46D 3/00
See application file for complete search history.

(56) References Cited

U.S. PATENT DOCUMENTS 2,849,740 A 9/1958 Pauker
4,480,350 A 11/1984 White
(Continued)

FOREIGN PATENT DOCUMENTS

CA 1023908 A1 1/1978
CN 2055356 U 4/1990
(Continued)

OTHER PUBLICATIONS

First Search issued in corresponding Chinese Application No. 201110396628.4 dated Aug. 1, 2013 (2 pages).
(Continued)

*Primary Examiner* — Randall Chin
(74) *Attorney, Agent, or Firm* — Osha Liang LLP

(57) ABSTRACT

A broom and a manufacturing method thereof, the broom comprising at least a broom handle (1) and a broom core; the bottom of the broom handle (1) is provided with a transverse plate (2); the broom core is fixed on the transverse plate (2), and comprises more than one bundle of brushes; the brushes are provided with dispersed slender resilient strips (9) thereon for cleaning the ground; the resilient strips (9) take up more than ½ the length of the brushes; the side surface of the resilient strips (9) is arc-shaped, and tapers from top to bottom; the bottom end of the resilient strips (9) is a thickened layer. The brushes of the broom are made by
(Continued)

cutting waste beverage bottles, solving the problem of environmental pollution caused by the waste beverage bottles; the manufacturing method is simple, thus reducing the production cost; the bottom end of the resilient strips (9) is a thickened layer (7), thus significantly improving wear resistance and stability and greatly extending service life compared to a bamboo broom.

4 Claims, 3 Drawing Sheets

(51) Int. Cl.

| | |
|---|---|
| ***A46B 3/08*** | (2006.01) |
| ***A46D 1/00*** | (2006.01) |
| ***A46D 1/05*** | (2006.01) |
| ***A47L 13/20*** | (2006.01) |

(52) U.S. Cl.
CPC ..... *A46D 3/00* (2013.01); *A47L 13/20* (2013.01); *A46B 2200/302* (2013.01)

(56) References Cited

U.S. PATENT DOCUMENTS 4,831,678 A * 5/1989 Dietsche ..... B25G 3/08 15/106
5,011,230 A * 4/1991 Weihrauch ..... A46B 3/06 300/21
2014/0331427 A1 11/2014 Cao et al.

FOREIGN PATENT DOCUMENTS

| | | | |
|---|---|---|---|
| CN | 2103985 | U | 5/1992 |
| CN | 2174155 | Y | 8/1994 |
| CN | 201098104 | Y | 8/2008 |
| CN | 201245825 | Y | 5/2009 |
| CN | 101779939 | A | 7/2010 |
| CN | 201551272 | U | 8/2010 |
| CN | 102518069 | A | 6/2012 |
| CN | 202386631 | U | 8/2012 |
| GB | 2150016 | A | 6/1985 |
| JP | 2001046293 | A | 2/2001 |
| KR | 20110097204 | A | 8/2011 |
| SU | 1818067 | C | 5/1993 |

OTHER PUBLICATIONS

International Search Report issued in PCT/CN2012/085318 dated Mar. 7, 2013 (4 pages).
Written Opinion of the International Searching Authority issued in PCT/CN2012/085318 dated Mar. 7, 2013 (13 pages).

* cited by examiner

BROOM AND MANUFACTURING METHOD THEREOF

FIELD OF THE INVENTION

The invention provides a broom for sweeping roads by cleaners, and a manufacturing method thereof, relating to the field of daily necessities.

DESCRIPTION OF THE PRIOR ART

At present cleaners usually use brooms made of bamboo when they sweep the road and other types of ground. The garbage and dust that cleaners sweep on the road are usually rather heavy, and the amount of which is extremely large, therefore the life span of a bamboo broom is only about a month, and the life span of a normal broom is shorter. There are the following disadvantages of the bamboo broom: 1. The bamboo broom is heavy, which will cause pain in the arms while the female cleaners are using bamboo brooms for a long time. 2. Manufacturing costs of the bamboo broom is high, because of high transportation costs of the materials of bamboo brooms, i.e. mao bamboo, mainly planted in the southern mountains.

With the development of society, beverage industry is also increasingly developed. Nowadays, beverage includes carbonated drinks, tea drinks, fruit drinks, milk drinks and pure water etc, most of which are stored with plastic bottles. After customers drink up the beverage in plastic bottles, some of the plastic bottles are collected to rubbish recycling stations for reuse as materials, and others are directly discarded which will pollute the environment. Many problems will be solved if these plastic bottles are recycled to be made into brooms. However the domestic research in this field is still blank currently.

SUMMARY OF THE INVENTION

The invention provides a broom for overcoming the disadvantages of the prior art, and having advantages of stable performance, long life and low manufacturing costs, and manufacturing method thereof.

In order to achieve the above objective, the invention adopts the following technical solution:

A broom comprises at least a broom handle and a broom core, the bottom of the broom handle is provided with a transverse plate; the broom core is fixed on the transverse plate, and comprises more than one bundle of brushes; the brushes are provided with dispersed slender resilient strips for cleaning the ground; the resilient strips takes up more than ½ the length of the broom core; the side surface of the resilient strips is arc-shaped, and tapers from top to bottom; and the bottom end of the resilient strips is a thickened layer.

The brush comprises three to ten inverted bottle-shaped cylinders superimposed in turn; the top of the cylinder is provided with a rounded top cover provided with a hole thereon, and the sidewall of the cylinder is slender resilient strips; the top end of the resilient strips is fixedly attached to the edge of the top cover in turn, and the arc-shaped resilient strips are curved from top to bottom; the brush is fixed on the bottom of the transverse plate through the hole on the top cover; there are more than two bundles of the brushes fixed on the transverse plate, positioned in turn along the length of the transverse plate.

The brush comprises six said cylinders superimposed in turn; there are three bundles of the brushes fixed on the transverse plate.

The brush comprises a pair of cleaning pieces that are fixed symmetrically and respectively on the front and rear surface of the transverse plate; the cleaning piece is flaky, the bottom thereof is the resilient strips, and the top of the resilient strips is integrally connected to the upper of the cleaning piece; arc-shaped resilient strips are curved from top to bottom toward the side of the cleaning piece, there are three to eight cleaning pieces superimposing each other, the upper portion thereof is fixed on the transverse plate; the resilient strips fixed on the front or rear surface of the cleaning piece are curved toward the corresponding side of the transverse plate.

There are six said cleaning pieces fixed on the front and rear surface of the transverse plate by bolt.

A method of manufacturing, the above broom, the specific steps of the method is:

(1) selecting empty plastic bottles of the same shape and size as raw materials;

(2) getting rid of bottle caps and labels of the plastic bottles;

(3) cutting the body, of the plastic bottle into ten to thirty resilient strips from the bottleneck towards the bottom of the plastic bottle, and the resilient strip takes up more than ½ the length of the plastic bottle;

(4) processing the bottom of the plastic bottle, and superimposing more than three processed plastic bottles to form a brush; fixing more than one brushes on the transverse plate located on the bottom of the broom handle, the resilient strips thereof pointing downward, so as to form the broom.

The processing of the bottom of the plastic bottle in the step (4), specifically, is opening a hole on the bottom of the plastic bottle in the center; and in turn superimposing six inverted said plastic bottles to form the brush; and then fixing three brushes on the bottom of the transverse plate by bolt.

The processing of the bottom of the plastic bottle in the step (4), specifically, is removing the bottom of the plastic bottle; and cutting open the body of the plastic bottle along the resilient strips so as to make it flaky, whereby a cleaning piece is made; and superimposing six cleaning pieces, and fixing them by bolt on the front surface of the transverse plate at the bottom of the broom handle, and in the same way, fixing symmetrically six cleaning pieces on the rear surface of the transverse plate; the cleaning pieces on the both of front and rear surface of the transverse plate together forming a brush.

Make cuttings to the bottleneck between the step (2) and the step (3), so that the bottleneck is left with a length of 2-8 mm.

The broom of the invention provides the following advantages:

1. The brushes of the broom are made by cutting waste beverage bottles, solving the problem of environmental pollution caused by the waste beverage bottles; the manufacturing method is simple, thus reducing production costs,
2. The material made into the brush is plastic, and the bottom of the resilient strips is a thickened layer corresponding to the bottleneck of the plastic bottle, thus significantly improving wear resistance and stability and greatly extending service life compared to a bamboo broom.
3. The resilient strips are resilient, thus more benefit the cleaning for heavier garbage, and the cleaning is thorough and comprehensive.

wherein: 1—broom 2—transverse plate 3—cylinder 4—brush 5—brush 6—bolt 7—thickened layer 8—cleaning piece 9—resilient strip 10—top cover.

DETAILED DESCRIPTION OF THE PREFERRED EMBODIMENTS

Below in conjunction with the accompanying drawings and specific embodiments, the invention will be more specifically described.

Example 1

Figure 1:
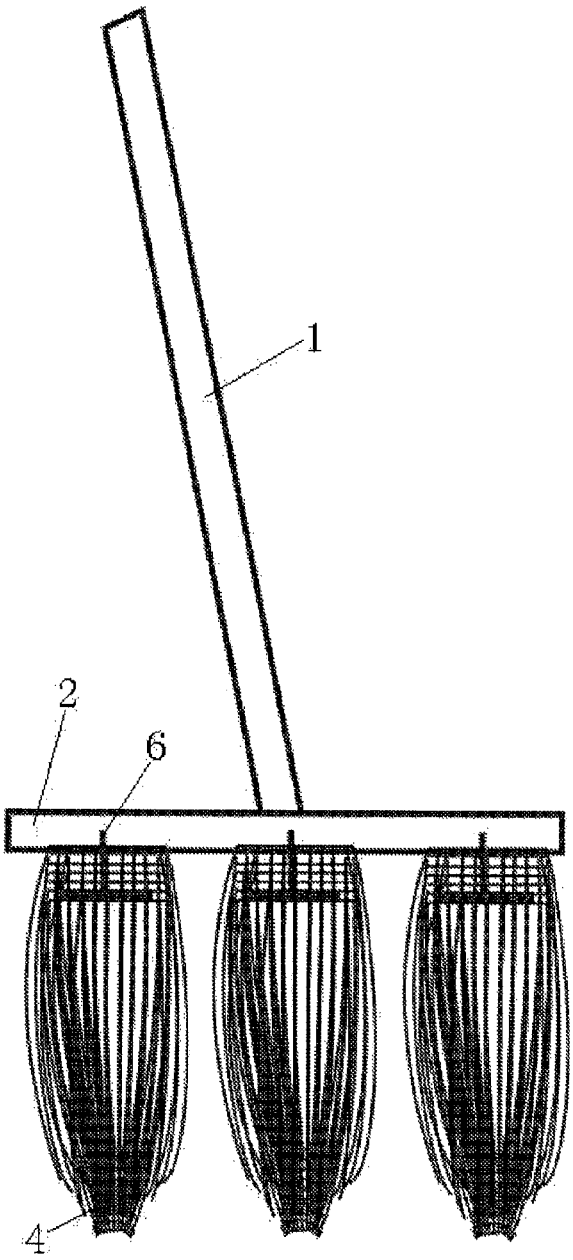
FIG. 1 is schematic view of the broom according to one embodiment of the invention.
Figure 2:
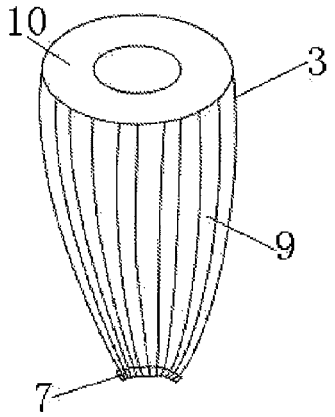
FIG. 2 is schematic view of the cylinder according to FIG. 1.

The structure of the broom provided by the present embodiment is shown in FIG. 1: comprising a broom handle 1 and a broom core, the bottom of the broom handle 1 is provided with a transverse plate 2, and the broom core is fixed on the transverse plate 2, and comprises more than two bundles of brushes 4. The brush 4 comprises three to ten inverted bottle-shaped cylinders 3 superimposed in turn. In the present embodiment the brush 4 comprises six inverted bottle-shaped cylinders 3 superimposed in turn. The structure of the cylinder 3 is shown in FIG. 2, the top of the cylinder 3 is provided with rounded top cover 10 provided with a hole thereon, and the sidewall of the cylinder 3 are dispersed slender resilient strips 9 for cleaning the ground; the resilient strips 9 takes up more than ½ the length of the brush; the side surface of the resilient strips 9 is arc-shaped, and tapers from top to bottom; and the bottom end of the resilient strips 9 is a thickened layer 7. The top end of the resilient strips 9 is fixedly attached to the edge of the top cover 10 in turn, and arc-shaped resilient strips 9 are curved from top to bottom.

The brush 4 is fixed on the bottom of the transverse plate 2 by a bolt 6 engaging through the hole in the top cover 10; there are more than two bundles of the brushes 4 fixed on the transverse plate 2, that in turn are positioned along the length of the transverse plate 2, in the present embodiment there are three bundles of the brushes 4 fixed on the transverse plate 2.

The manufacturing method of the broom in the present embodiment is: first, select eighteen 600 ml plastic; bottles of NONGFU mountain spring brand, and get rid of bottle caps and labels thereof and empty liquid therein, and then cut away a portion of the bottleneck, the remaining portion with 2-8 mm left thereof is connected to the bottle body. In the present embodiment the remaining portion is of 5 mm. Then use hay cutter to cut the body of the bottle into ten to thirty resilient strips from the bottleneck towards the bottom of the bottle, the number of resilient strips in the present embodiment is 20; the length of resilient strips are more than ½ the length of the bottle, one end of the resilient strips is a thickened layer corresponding to the bottleneck, the other end is integrally connected to the body of the bottle. Open a hole in the center of the bottom of the bottle after being cut, and in turn superimposing six inverted bottles to produce a brush. Then, with the resilient strips thereon facing downward, fixing three brushes on the bottom surface of the transverse plate through bolts, so as to produce a broom as shown in FIG. 1.

Example 2

Figure 3:
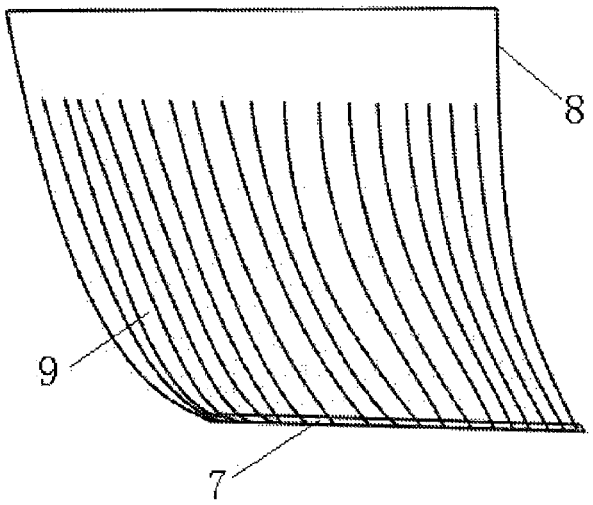
FIG. 3 is schematic view of the cleaning piece.
Figure 4:
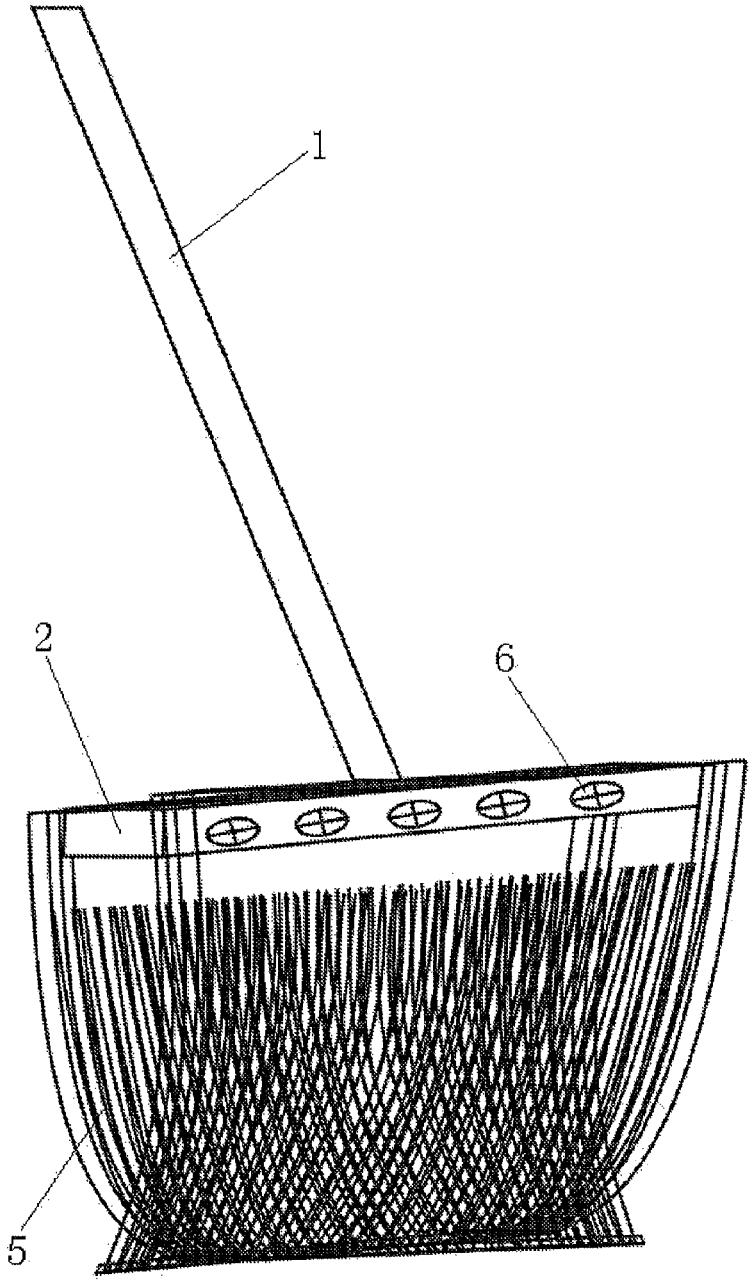
FIG. 4 is schematic view of the broom according to another embodiment of the invention.

The structure of the broom provided by the present embodiment is shown in FIG. 4: comprising a broom handle 1 and a broom core. The bottom of the broom handle 1 is provided with a transverse plate 2. The broom core is fixed on the transverse plate 2, and comprises more than one bundle of brushes 5. The brush 5 comprises a pair of cleaning pieces 8 fixed symmetrically and respectively, on the front and rear surface of the transverse plate 2; the structure of the cleaning piece 8 is shown in FIG. 3. The cleaning piece 8 is flaky and the bottom portion thereof are dispersed resilient strips 9 for cleaning the ground; the length of resilient strips 9 takes up more than ½ the length of the brush; the side surface of the resilient strips 9 is arc-shaped and tapers from top to bottom, and the bottom end of the resilient strips 9 is a thickened layer 7. The top of the resilient strips 9 is integrally connected to the upper of the cleaning piece 8; arc-shaped resilient strips 9 are curved from top to bottom toward the direction of the cleaning piece 8; there are three to eight cleaning pieces 8 superimposing each other; the upper thereof is fixed on the transverse plate 2. In the present embodiment there are six cleaning pieces 8 fixed on each of the front and rear surface of the transverse plate 2 by bolt 6. The resilient strips fixed on the front or rear surface of the cleaning piece 8 are curved toward the corresponding side of the transverse plate 2.

The manufacturing method of the broom in the present embodiment is: first, select twelve 500 ml plastic bottles of MASTER KANO brand, get rid of bottle caps and labels thereof and empty liquid therein, and then cut off a portion of the bottleneck so that the remaining portion with 2-8 mm left thereof is connected to the bottle body. In the present embodiment the remaining portion is of 3 mm. Then apply hay cutter to cut the body of the bottle into 10-30 resilient strips from the bottleneck towards the bottom of the bottle; there are 20 resilient strips in the present embodiment; the resilient strip is more than ½ the length of the bottle; one end of the resilient strips is a thickened layer corresponding to the bottleneck; the other end is integrally connected to the body of the bottle. Scissor off the bottom of the bottle, and then cut the body of the bottle open along resilient strips so as to make it flaky, so as to produce a cleaning piece as shown in FIG. 3. Superimpose six cleaning pieces and fix these cleaning pieces though bolts on the front surface of the transverse plate located on the bottom of the broom handle; in the same way, fix symmetrically six cleaning pieces on the back of the transverse plate by bolt; the resilient strips fixed on the front or rear surface of the cleaning piece are curved toward the corresponding side of the transverse plate. The broom as shown in FIG. 4 may be manufactured using the above procedure.

What is claimed is:

1. A method of manufacturing a broom comprising at least a broom handle and a broom core, wherein a bottom of the broom handle is provided with a transverse plate; the broom core is fixed on the transverse plate, and comprises more than one bundle of brushes provided with dispersed slender resilient strips for cleaning a ground; the resilient strips take up more than ½ the length of the brush; a side surface of the resilient strips is arc-shaped, and tapers from top to bottom; and a bottom end of the resilient strips is a thickened layer, the specific steps of the method is:

a. selecting empty plastic bottles of same shape and size as raw materials;

b. getting rid of bottle caps and labels of the plastic bottles;

c. cutting the body of the plastic bottle into ten to thirty resilient strips from a bottleneck towards the bottom of the plastic bottle, the resilient strip takes up more than ½ the length of the plastic bottle;

d. processing the bottom of the plastic bottle, and superimposing more than three processed plastic bottles to form a brush; fixing more than one brush on the transverse plate located on the bottom of the broom handle, the resilient strips thereof pointing downward, so as to form the broom.

2. The method according to claim 1, characterized in that the processing of the bottom of the plastic bottle in the step (d), specifically, is opening a hole on the bottom of the plastic bottle in the center, and in turn superimposing six inverted plastic bottles to form a brush; and then fixing three brushes on the bottom of the transverse plate though bolts.

3. The method according to claim 1, characterized in that the processing of the bottom of the plastic bottle in the step (d), specifically, is removing the bottom of the plastic bottle; and cutting open the body of the plastic bottle along the resilient strips so as to make it flaky, whereby a cleaning piece is made; and superimposing six cleaning pieces, and then fixing them by bolt on the front surface of the transverse plate at the bottom of the broom handle, and in the same way, fixing symmetrically six cleaning pieces on the rear surface of the transverse plate; the cleaning pieces on the both of the front and rear surface of the transverse plate together forming a brush.

4. The method according to claim 1, characterized in that, cut the bottleneck between the step (b) and the step (c), so that the bottleneck is left with a length of 2-8 mm.

* * * * *